US007611235B2

(12) United States Patent
Richards

(10) Patent No.: US 7,611,235 B2
(45) Date of Patent: Nov. 3, 2009

(54) METHOD AND DEVICE TO PREVENT REFILL OF CARTRIDGE

(76) Inventor: Thomas Richards, 820 Surrey La., Lexington, KY (US) 40503

( * ) Notice: Subject to any disclaimer, the term of this patent is extended or adjusted under 35 U.S.C. 154(b) by 0 days.

(21) Appl. No.: 12/075,717

(22) Filed: Mar. 13, 2008

(65) Prior Publication Data

US 2008/0165230 A1 Jul. 10, 2008

Related U.S. Application Data

(60) Provisional application No. 60/964,961, filed on Aug. 17, 2007.

(51) Int. Cl.
*B41J 2/175* (2006.01)

(52) U.S. Cl. ..... 347/86

(58) Field of Classification Search ..... 347/84, 347/85

See application file for complete search history.

(56) References Cited

U.S. PATENT DOCUMENTS 2,750,901 A * 6/1956 McClellan ..... 109/59 R
4,365,035 A 12/1982 Zabiak
5,504,510 A * 4/1996 Miyakawa ..... 347/85
5,510,820 A 4/1996 Aulick et al.
5,661,510 A 8/1997 Brandon et al.
5,940,103 A 8/1999 Hetzer et al.
6,099,101 A 8/2000 Maurelli et al.
6,161,927 A 12/2000 Long et al.
6,325,495 B1 12/2001 Foth
6,350,026 B1 2/2002 Lin
6,511,142 B1 * 1/2003 Carmon et al. ..... 347/7
6,837,576 B2 1/2005 Whitlock et al.
6,971,740 B2 12/2005 Yuen

* cited by examiner

*Primary Examiner*—Stephen D Meier
*Assistant Examiner*—Alexander C Witkowski
(74) *Attorney, Agent, or Firm*—Michael Coblenz

(57) ABSTRACT

A method and device to prevent the refill of cartridges, including inject and laser printer cartridges. The device includes a cage made of hardened drill resistant material inserted within the central reservoir of the cartridge to prevent drilling into the cartridge. The device also includes a bit grabbing mesh designed to grab or catch any drill bit able to penetrate the drill resistant cage, thus impeding the ability of a refiller to drill holes into the central reservoir. The device also includes at least two pressure sensitive check valves that close if a refiller attempts to introduce refill ink either by forcing it in under pressure or by drawing it in by means of a vacuum created within the central reservoir. Finally, the device includes a number of packets containing an ink altering material that would be released and foul any refill ink during an attempt to refill the cartridge.

29 Claims, 5 Drawing Sheets

METHOD AND DEVICE TO PREVENT REFILL OF CARTRIDGE

CROSS REFERENCE TO RELATED APPLICATIONS

This application claims priority to U.S. Provisional Patent Application No. 60/964,961 filed on Aug. 17, 2007.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

FIELD OF THE INVENTION

The present invention relates to a method and device for the prevention of the unauthorized refilling of a cartridge, and in particular an inkjet and laser or xerographic printer cartridge.

BACKGROUND OF THE INVENTION

There are two common types of modern computer printers, inkjet and laser printers. Inkjet printers are the most common for home computer use. The inkjet printer consists of a printer body that holds and moves paper, and the inkjet printer cartridge that contains ink and a print head. The paper is moved from top to bottom by the printer, and the inkjet print cartridge is mounted on a carrier that moves horizontally and allows it to dispense ink in the appropriate patterns across the page.

The ink print cartridges are not simply reservoirs full of ink. These cartridges also contain the actual print head. See, for example, U.S. Pat. No. 5,675,367 to Scheffelin et al, which discloses an integrated print head along with a reservoir for holding ink. This configuration of the integrated print head and cartridge containing ink is the industry standard, and all of the major printer and cartridge manufacturers, including, but not limited to Dell, Hewlett-Packard, Epson, Brother, and Lexmark, use these types of inkjet cartridges.

The current business model for many of the manufacturer's of inkjet printers is to sell the printer relatively cheaply, and then make most of their money by selling replacement ink print cartridges. In general, inkjet printer manufacturers have structured their business model similar to the manufacturers of razor blades. They sell the printer (or razor) at very little profit, and reap most of the product profit from the sale of subsequent supplies (ink cartridges or razor blades). In recent years, however, the ink jet printer manufacturers have been loosing more and more of the profit from the sale of new or remanufactured ink jet cartridges to refillers. Refillers are either companies set up specifically to refill empty ink jet cartridges or individual consumers who refill their cartridges on their own. Companies that refill empty cartridges sell them for a lower price than new ones sold by the printer manufacturer. Individual consumers can purchase refill kits that will allow them to refill a cartridge multiple times for less than the cost of a single new ink cartridge. One Harvard Business School professor estimated that "private branded label offerings now constitute nearly 30 percent of the worldwide ink market." (Professor Clayton M. Christensen, "Will Kodak's New Strategy Work?" by Clayton M. Christensen and Scott D. Anthony, Published on Forbes.com, Feb. 26, 2007.)

This business model has helped keep the cost of replacement printer inkjet cartridges (hereinafter "cartridges") relatively high. As a result, a number of companies have developed, manufacture and sell compatible replacement cartridges. For example, most office supply stores such as Office Max, Office Depot and Staples, have generic or store brand replacement cartridges. Initially a number of printer manufacturers attempted to develop technology to prevent the use of non-genuine or non-branded replacement cartridges, but the courts struck that down. See, for example, *Lexmark International, Inc. v. Static Control Components, Inc.,* 387 F.3d 522 (6th Cir. 2004). But even these "knock-off" replacement cartridges are relatively expensive, so there is still a financial incentive to find ways to refill existing cartridges.

While there are many different ways to refill an inkjet cartridge, there are three that are most common. The first involves simply drilling a small hole into the central reservoir of the cartridge and injecting ink with a syringe having a small diameter needle. The second involves dripping ink into the vent holes of the cartridge. The third involves subjecting the interior of the cartridge to a negative pressure by means of a vacuum device, and then putting either the print head portion or the vent holes of the cartridge into liquid ink, and allowing the ink to flow into the central reservoir of the cartridge due to the pressure differential. Examples of patents that disclose refilling methods include U.S. Pat. Nos. 5,199,470; 5,400,573; 5,546,830; 5,572,852; 5,819,627; 5,845,682; 6,347,863; and 6,971,740.

At least one method to prohibit the refilling of ink jet cartridges has already been patented. That method is described in U.S. Pat. No. 6,099,101 to Maurelli. The method described in the '101 patent involves placing a monitoring and disabling device inside the ink jet print head cartridge. When the print head has exceeded its useful life span, the disabling device disables the print head cartridge through the electrical discharge from capacitors that essentially burns out and renders the print nozzles permanently inactive. This patent describes the use of ink sensors to determine when the print head has exceeded its useful life. Another possible variation on this approach would be the incorporation of a "computer chip" within the ink cartridge that would "count" the number of times that one or more of the print head nozzles was energized. From that count the number of print drops from those nozzles would be known and thus some inference could be made on the amount of ink left in the cartridge. The cartridge could then be made inoperable after a certain number of drops were printed through communication of a specific instruction code to a printer processor. That scheme could be designed to enable the "chip" to be reset when the cartridge was remanufactured or refilled by an approved entity without destroying the cartridge. This is somewhat similar to the process disclosed in U.S. Pat. No. 6,325,495 to Foth, which incorporates a computer chip, or "smart button cell" that prevents the print head from functioning after a preset number of uses.

Both of these refill prevention methods involve the use of electronic or computer equipment. Unfortunately, virtually any electronic or computer fix can be bypassed by a skilled computer expert. There is a need, therefore, for a relatively inexpensive non-electronic method for the prevention of refilling of inkjet cartridges.

SUMMARY OF THE INVENTION

The present invention is drawn to a system for the prevention of refilling cartridges with a refill material. For inkjet cartridges the refill material is ink, and for laser or xerographic cartridges the refill material is toner. The system contains four independent prevention elements that can work independently or in conjunction to prevent the refill or re-use of cartridges. Because there is no way to know how a refiller might attempt to refill the cartridge, using all four elements in conjunction offers the most complete protection against refilling a cartridge.

Since one common method of refilling an inkjet or laser printer cartridge involves drilling a small hole into the central reservoir and injecting ink (for inkjet cartridges) or pouring in toner (for laser printer cartridges), one prevention element consists of a drill resistant cage built within the central reservoir. This drill resistant cage can be made of a solid thin metal material with high hardness or drill resistance to prevent a drill from puncturing into the reservoir. The hardened drill resistant cage would eliminate most common attempts at drilling into the cartridge, thus preventing refill.

Some refillers, however, might use a carbide or diamond tipped drill that could penetrate the drill resistant cage. In those cases drilling can be prevented by means of a metal mesh that would entangle or "catch" a drill bit that penetrated the steel cage, and make it difficult to remove the drill bit from the cartridge.

The second most common method of refilling inkjet cartridges involves the creation of a vacuum inside the cartridge and immersion of either the print head or the top of the cartridge into a container of ink. The vacuum inside the cartridge draws the ink in through the print head or vent holes in the top of the cartridge. This method of refilling can be prevented by the use of pressure valves that would close when the pressure inside the cartridge is altered significantly, thus preventing the inflow of refill ink.

Finally, the use of ink altering material contained in packets is disclosed. The packets would be placed where drilling is most common, thereby resulting in the release of material that would foul the ink and prevent the further use of the cartridge. In another embodiment the packets would be pressure sensitive and would open when the cartridge is subjected to a substantial change in pressure, thus releasing the ink altering material that would modify the cartridge ink in such a manner as to prevent the further use of the cartridge.

While the present invention is drawn to the prevention of refill of inkjet cartridges, many aspects of the invention can also be applied for use in laser printer or xerographic printer cartridges. Laser or xerographic cartridges are similar to inkjet cartridges in two respects. First, they contain a number of fairly expensive electro-photographic components in addition to a reservoir containing the printing medium. For inkjet cartridges the printing medium is liquid ink, but for laser or xerographic cartridges the printing medium is a powdered "toner." Typically, when the toner in the laser or xerographic printer cartridge is depleted, the cartridge is discarded. Due to the cost of replacement laser cartridges, however, a refilling market has developed. The most common method of refilling laser cartridges involves drilling a hole into the cartridge and pouring in more toner. The prevention methods disclosed herein to prevent drilling into a central reservoir will, therefore, work equally well with a laser cartridge as with an ink-jet cartridge.

These and other aspects, features and advantages of the present invention will become apparent from the following detailed description taken in conjunction with the accompanying drawings.

DETAILED DESCRIPTION OF THE INVENTION

Detailed embodiments of the present invention are disclosed herein. It is to be understood, however, that the disclosed embodiments are merely exemplary of the invention and that the invention may be embodied in various and alternative forms. Therefore, specified structural and functional details disclosed herein are not to be interpreted as limitations, but merely as a basis for the claims and as a representative basis for teaching one skilled in the art to variously employ the present invention.

Figure 1:
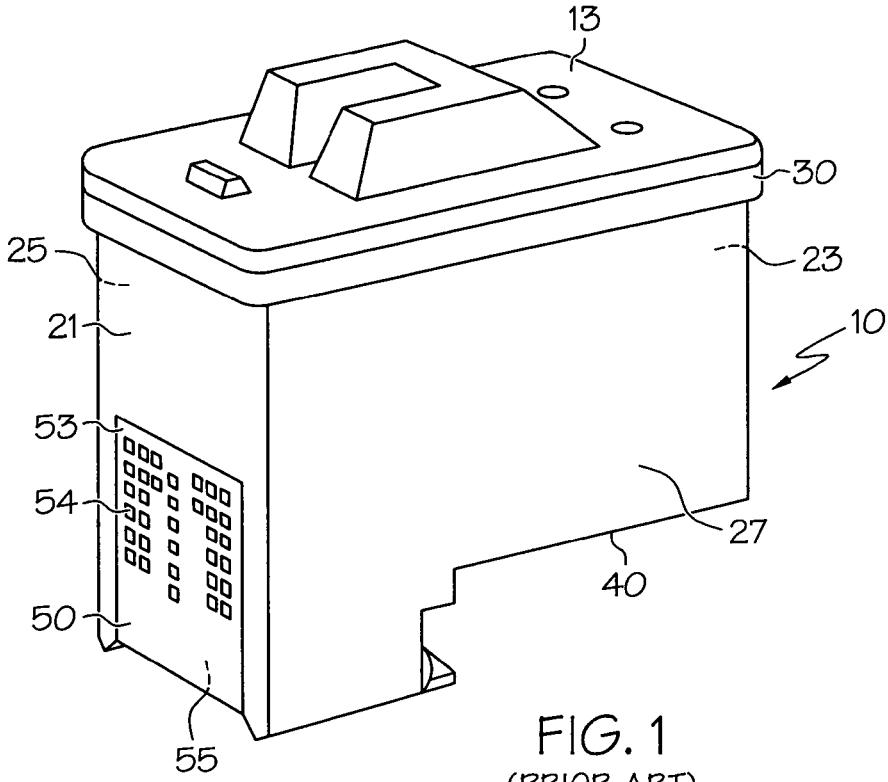
FIG. 1 (PRIOR ART)
FIG. 1 is a perspective view of a representative prior art ink-jet printer cartridge.

FIG. 1 shows a representative prior art inkjet printer cartridge. There are numerous existing inkjet printer cartridges (hereinafter "cartridge" 10) on the market, but they all have common features. All cartridges 10 have a body defined by a front wall 21, a back wall 23, a top 30, a bottom 40, a left wall 25 and a right wall 27. In most cases these walls create a rectangular box with the walls meeting at right angles, but it is possible, and within the conception of the invention, for these walls to form a non-rectangular shaped cartridge 10. It is possible that the cartridge 10 is spherical, cylindrical, or rounded, and in those cases the elements defined as a front wall 21, a back wall 23, a top 30, a bottom 40, a left wall 25 and a right wall 27 would not be flat and with right angles, as depicted in the figures, but would be curved, rounded, or shaped to conform to the three dimensional configuration of the cartridge 10. But all cartridges 10 are three dimensional and as such will have a front portion, a back portion, a top portion, a bottom portion, a left side portion and a right side portion. In those cases where the cartridge 10 is cylindrical or spherical, these portions will be contiguous, and will not meet at ninety degree angles, as in those configurations where the cartridge 10 is a rectangular three dimensional shape. For consistency and simplicity sake, the front portion, back portion, top portion, bottom portion, left side portion and right side portion will be referred to as a front wall 21, a back wall 23, a top 30, a bottom 40, a left wall 25 and a right wall 27. Some, but not all, cartridges 10 also have a separate top cover 13. The external size, shape, and configuration of cartridges 10 vary by manufacturer to correspond to the requirements of the printers, and the external configuration is not material to the present invention. While the exact dimensions and configurations vary, prior art inkjet cartridges are relatively small, generally with dimensions ranging from less than an inch to a few inches in width, depth and height.

All cartridges 10 also contain a print head 50. Modern inkjet printers use cartridges 10 that have the print head 50 as an integral part of the cartridge 10. The print head 50 typically consists of a thin strip 53 which contains electric connectors 54, which electronically connect the print head 50 with the printer (not shown). Print heads 50 also contain nozzles 55 or small holes for imparting ink 17 onto the paper or other material to be printed. In FIG. 1 the nozzles 55 are on the underside of the cartridge 10 and are not visible. Such cartridges 10 with integrated print heads 50 are well known in the prior art, and the internal workings of the print head 50 with the printer is not part of the disclosed invention.

Figure 2:
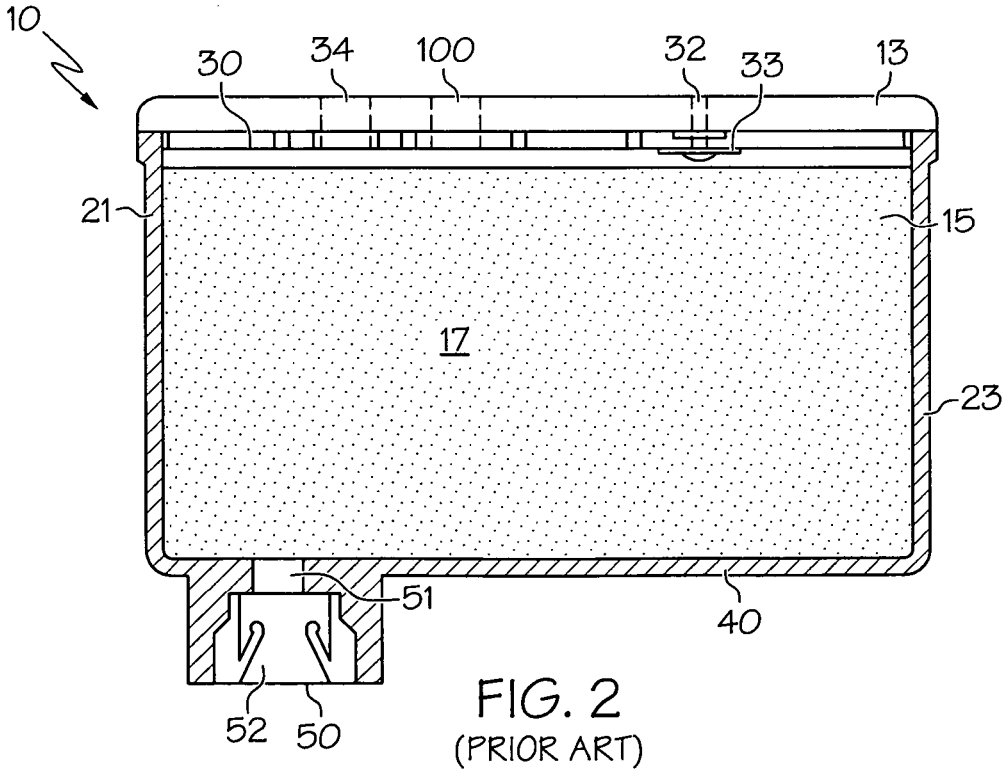
FIG. 2 (PRIOR ART)
FIG. 2 is a sectional view of a representative prior art ink-jet printer cartridge.

FIG. 2 is a sectional view of a prior art cartridge 10 that shows the interior of a typical cartridge 10. (Note that the cartridge depicted in FIG. 2 has a slightly different configuration than the cartridge of FIG. 1.) The top 30, bottom 40, front wall 21, back wall 23, left wall 25 (not shown) and right wall 27 (not shown) form in internal central reservoir 15. Ink 17 for printing is contained within this central reservoir 15. In many cartridges 10 the ink 17 is suspended in a sponge like foam (not shown). This foam helps physically stabilize the ink 17, preventing it from sloshing or moving excessively within the central reservoir 15. Details of this sponge like foam are well known in the art, and are not part of the disclosed invention.

Ink 17 comes in a variety of colors, but the most common color for standard printing is black, which is used for most document printings. Color printing is increasingly common, and there are at least two different ways that color ink is used in inkjet printing. In one method a single cartridge contains typically three reservoirs, with three separate colors, typically cyan (a shade of blue), magenta (a purplish-red shade), and yellow. In another method a number of separate cartridges are used, each containing a single color of ink. The present invention can work with any type and configuration of prior art cartridge, and the details of color printing, which are well known in the prior art, are not material or disclosed.

Pigment and dye based inks are well known in the art. Ink 17 is typically made up of a combination of an aqueous solution, a pigment or dye, and a resin or plasticizer. The aqueous solution is typically water, which holds the coloration provided by the pigment or dye, and the resin or plasticizer is a material that allows the pigment to adhere to the paper or other material to be printed. Details of ink can be found in U.S. Pat. Nos. 4,365,035, 6,261,350 and 7,192,472. The background of U.S. Pat. No. 6,261,350 provides a good discussion of dye ink formulation and problems associated with printing. It also sets out some of the typical properties of ink dyes. According to the disclosure in U.S. Pat. No. 7,192,472, drop velocity, the separation length of the droplets, the drop size and the stream stability are greatly affected by the surface tension and the viscosity of the ink. Ink jet inks typically have a surface tension in the range of about 20 dyne/cm to about 70 dyne/cm at 25.degree. C. Viscosity can be as high as 30 cP at 25.degree. C. (30 cP or less), but is typically somewhat lower. Inks have physical properties that are adjusted to the ejecting conditions and print-head design. In order for the inkjet printer to work properly, the ink must be within certain parameters, particularly surface tension and viscosity, but also pH and electrical resistively. If ink is outside of these parameters it can cause printing problems. For example if the viscosity or surface tension of the ink is too high, the ink can gum up and clog the nozzles. If these properties are too low, the ink will be too wet and will not properly adhere to the paper.

Most inkjet printers are placed on desktops for use, and are, therefore, generally placed in a horizontal or nearly horizontal position. Inkjet cartridges 10 are inserted into the printer with the print head 50 at the lowest point. This allows the ink 17 to flow to the print head 50 by means of gravity. There are numerous internal configurations for print heads 50, but they typically contain a channel 51 by which the ink 17 flows from the central reservoir 15 to the print head 50. Some print heads 50 also contain an ink dispensing outlet 52, which is connected to the nozzles 55, which dispense the ink 17 onto the paper in the printer. Details of printing are well known in the art and are not pertinent to the operation of the present invention, so are not more fully described.

Typical prior art cartridges 10 also contain an ink fill valve 34 located in the top 30 or top cover 13 of the cartridge 10. In those cartridges 10 that have a separate top 30 and top covers 13, there are two possible configurations for the fill valve 34. In one configuration, the top cover 13 is removable and the fill valve 34 is located in the top 30. The other possibility is that the fill valve 34 extends through both the top cover 13 and the top 30. In some prior art cartridges 10 the ink fill valve 34 is located in one of the walls of the cartridge, but near the top 30. As can be appreciated the ink 17 will generally be inserted into the cartridge 10 at or near the top 30 which will allow gravity to fill the central reservoir 15. Depending on the manufacturer's requirements, the fill valve 34 may be permanently sealed, or may have a removable stopper.

Typical prior art cartridges 10 contain one or more vents 32 located in the top 30. The vents 32 are necessary to allow air to flow into the central reservoir 15 to allow the ink 17 to flow out of the cartridge 10. Without the vents 32, a vacuum could build up in the cartridge 10 and impede the proper flow of the ink 17. Even a relatively low pressure could impede the proper flow of the ink 17. In color cartridges where there are three reservoirs holding each of the three colored inks there will be at least three vents 32, one for each reservoir. The vents 32 are typically quite small, with diameters small enough to allow air in, but not large enough to allow ink 17 to easily flow out of. Typical ink 17 has a viscosity and surface tension that would prevent the easy flow from a small bore vent 32. In some cartridges 10 the vent 32 has a stop valve 33 to prevent the ink 17 from flowing out of the vent 32. Some prior art cartridges 10 include an absorbent material, such as foam or sponge material, disposed within the central reservoir 15 to help prevent the ink 17 from sloshing around within the central reservoir 15, and this material will prevent the flow of the ink 17 out of the vents 32 or fill valve 34.

Prior art cartridges 10 are typically made from plastics or plastic composite material. This material is inexpensive, easy to mold and lightweight, and this keeps the cost of producing the cartridges 10 relatively low. While the cost of producing the cartridges 10 and of filling them with ink 17 is relatively low, the price of inkjet cartridges is generally high. This has led to a market for refilling cartridges. As mentioned previously, there are a number of methods for refilling cartridges 10. Some manufacturers allow the ink fill valve 34 to be reused, which allows a refiller to insert replacement ink 17 through the original ink fill valve 34. Some manufacturers, however, want to prevent the refill of their cartridges 10, and design the ink fill valve 34 to have a single use. In those cases, the most common method to refill involves drilling a refill hole 100 through the top 30 of the cartridge 10, or through the top cover 13 and top 30, and injecting ink 17. Often the refill hole 100 is small and ink 17 is injected by means of a syringe and needle. But in other cases the refill hole 100 is slightly larger and ink 17 is injected by means of a tube. As can be appreciated, when this method is used the refill hole 100 is drilled either in the top cover 13 and top 30 or in one of the walls near the top 30 most commonly the back wall 23. A second common method of refilling cartridges 10 involves removing the top cover 13 in those configurations where the top cover 13 is present, and inserting refill ink 17 either directly into the central reservoir 15, or into the central reservoir 15 through the vent holes 32 in the top 30.

A third common method of refilling cartridges 10 involves immersing the print head 50 into a container of ink, and then producing negative pressure in the central reservoir 15, which will suck ink 17 back into the central reservoir 15 through the nozzles 55 of the print head 50. A variation of this method involves flipping over the cartridge 10 and immersing the top 30 or top cover 13 of the cartridge 10 in a container of ink, and then producing negative pressure in the central reservoir 15, which will suck ink 17 back into the central reservoir 15 through the vent hole 32 or refill hole 100. Negative pressure is produced within the central reservoir 15 by, among other common methods, connecting a pump to the vent holes 32, refill hole 100, or print head 50 and pumping out the air from the central reservoir 15. A related refill method involves placing the cartridge 10 into a container of ink and imparting pressure onto the ink, thus forcing the ink into the cartridge 10.

The present invention prevents these common refilling techniques.

Figure 3:
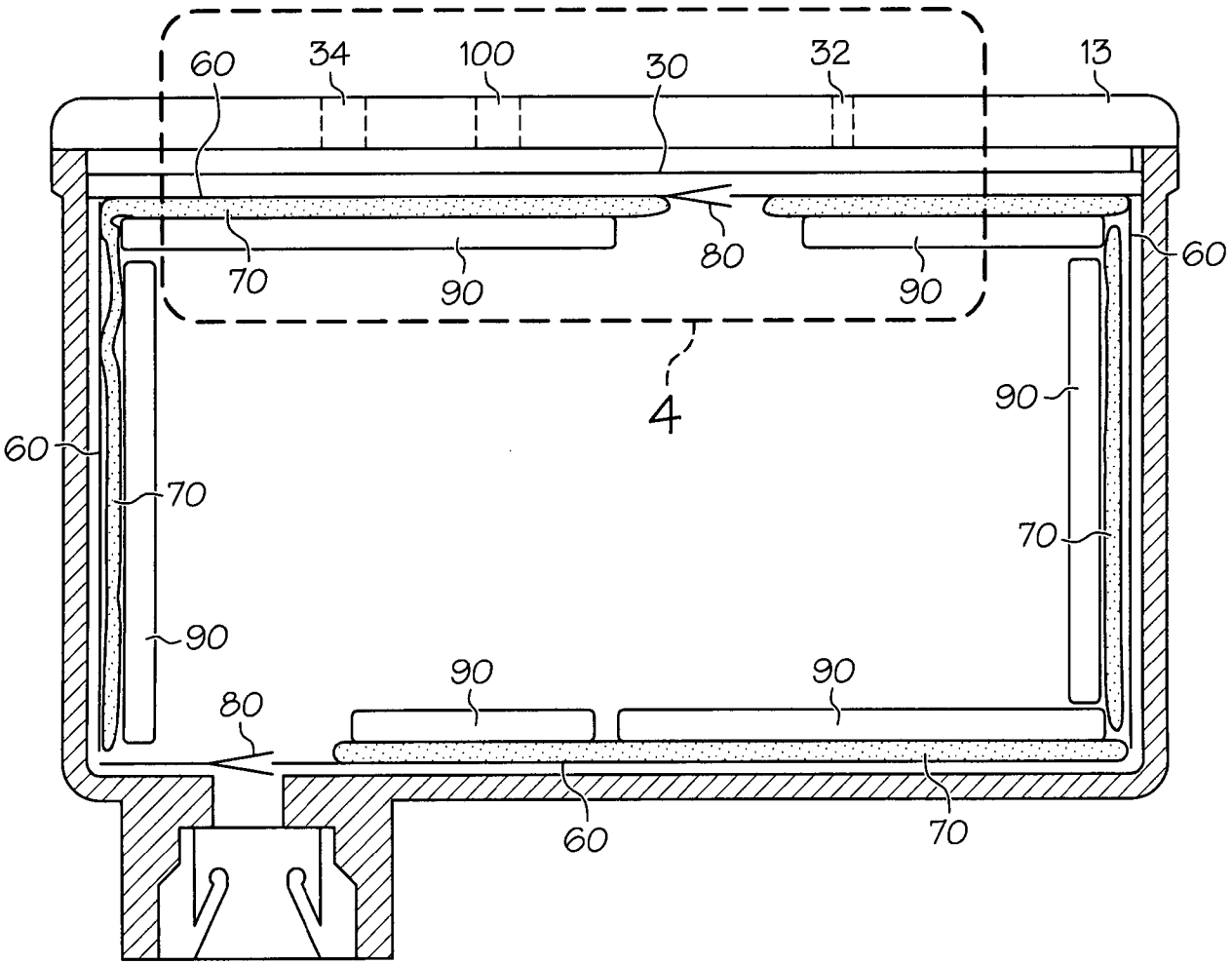
FIG. 3 is a sectional view of the invention.
Figure 4:
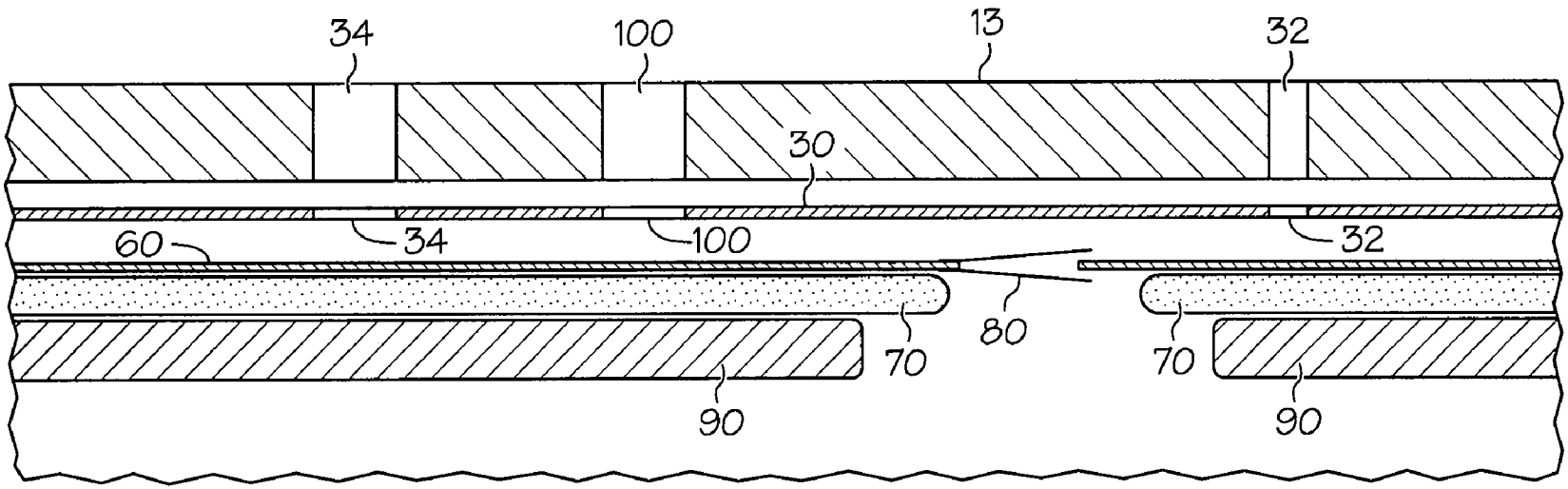
FIG. 4 is a detailed sectional view of the top portion of the invention.

FIG. 3 is a section view of a representative cartridge 10 containing all elements of the disclosed invention. The disclosed invention consists of a drill resistant cage 60, a bit grabbing mesh 70, at least two pressure sensitive check valves 80, and a number of ink altering packets 90 disposed within the central reservoir 15 of the cartridge 10. FIG. 4 is a detailed sectional view of a cartridge 10 showing the general arrangement of the four refill prevention elements, the drill resistant cage 60, the bit grabbing mesh 70, one of the check valves 80, and an ink altering packet 90. FIGS. 3 & 4 depict elements of the invention as used in a representative a prior art cartridge 10 with both a cartridge top 30 and a top cover 13, and show the vent 32 and fill valve 34 running directly through both the top cover 13 and the top 30. In many configurations of prior art cartridges 10, the holes for the vent 32 and the fill valve 34 do not line up, and in other configurations, particularly where the top cover 13 is removable, there may not be a fill valve 34 in the top cover 13. These details of prior art cartridges vary significantly from one manufacturer to another, and the exact placement and existence of vents 32 and fill valves 34 are not material to the disclosed invention.

Figure 5:
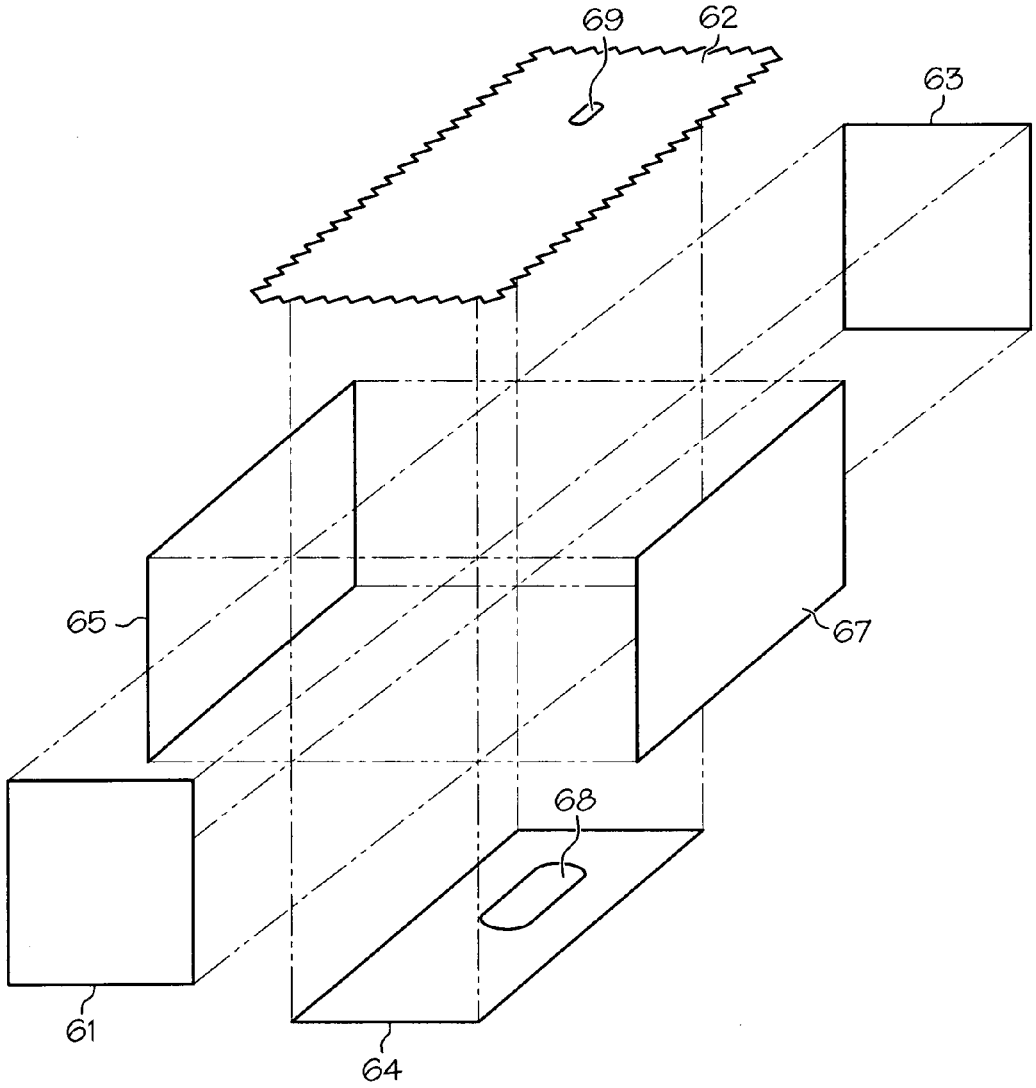
FIG. 5 is an exploded view of the steel cage element of the invention.

As shown in more detail in FIG. 5, the drill resistant cage 60 is made up of a number of sheets of thin hardened drill resistant stainless steel or other drill resistant non-corroding metal or hardened material that is disposed against the inside walls of the cartridge 10. The drill resistant cage 60 will be of sufficient hardness to prevent the easy drilling of refill holes with conventional drill bits through the walls of the cartridge 10. In the preferred embodiment the steel for the drill resistant cage 60 is a heat treatable 400 series stainless steel that is stamped, formed and heat treated to about rc 50-55 to make it relatively drill resistant. In the preferred embodiment, the material thickness is approximately 0.005 inches. In alternate embodiments, the steel can be both thicker and thinner, ranging from approximately 0.003 to 0.02 inches thick. Other sufficiently hard, durable, and non-corrosive materials could be used, including a variety of metals such as copper alloy, as well as ceramics, composites and carbides. There is clearly greater drill resistance with thicker material, but thicker material would decrease the ink holding volume of the central reservoir 15. Therefore, the only limiting factor in the material used is a positive relationship between drill resistance, thickness, and cost.

In the preferred embodiment, the drill resistant cage 60 has a cage top 62, a cage bottom 64, a cage front wall 61, a cage back wall 63, a cage left wall 65 and a cage right wall 67, that corresponded with and are disposed against the respective cartridge 10 top 30, bottom 40, front wall 21, back wall 23, left wall 25 and right wall 27. In the preferred embodiment, the cage top 62, cage bottom 64, cage front wall 61, cage back wall 63, cage left wall 65 and cage right wall 67 are closely aligned and form an almost integral cage 60 recessed within the central reservoir 15. There is at least one cage vent hole 69 in the cage top 62, and an ink opening 68 in the cage bottom 64 to allow ink 17 to flow out of the drill resistant cage 60. In the preferred embodiment, the walls of the drill resistant cage 60 are cut from several pieces of material. The cage front 61, right wall 67, and cage back 63 are cut from a single piece of material and bent to form the appropriate angles. Similarly, the left wall 65 and cage bottom 64 are also cut from a single piece of material and bent to form the adjoining pieces. This will increase the rigidity of the walls, and prevent them from easily moving should a refiner drill into a cartridge 10 wall. Only the cage top 62 would be cut from its own sheet of material. In alternate embodiments all of the pieces of the drill resistant cage 60 can be separate.

In alternate embodiments the drill resistant cage 60 could consist of only the cage top 62, since this is where most refiners drill refill holes 100. In this embodiment, the cage top 62 would be separate from the other walls of the drill resistant cage 60, and could be bonded to the cartridge top 30. Alternatively, the cage top 62 could also have minute serrated edges which would interfere with the main walls of the cartridge body. The cage top 62 would then be assembled to the cartridge body, after the ink 17 had been introduced into the cartridge during, original manufacture, the top serrations would "dig" into the cartridge walls. The cage top 62, in addition to having serrated edges, could have those edges bent very slightly upward at an angle to the plane of the cage top 62. Upon insertion into the cartridge body, the serrated edges of the cage top 62 would be deflected a slight additional amount in the direction of their original bend to further increase the difficulty of removing the cage top 62. In order to maximize the effectiveness of the drill resistant cage 60, it is essential that the vent holes 69 in the cage top 62 be very small in diameter, the top 30 be permanently bonded to the cartridge 10, and the top cover 13 be permanently bonded to the cartridge 10 in those cartridges where the vent holes 32 in the top cover 13 are very small and those in the top 30 are large enough for easy introduction of ink 17 into the central reservoir 15 of the cartridge 10. This would eliminate the ability to refill the cartridge 10 by removing the outer cartridge top cover 13 and filling the central reservoir 15 through the vent holes 32 in the top 30, and the cage vent hole 69. It would also eliminate the ability to simply remove the top cover 13, top 30 and cage top 62 to refill the cartridge 10. Additionally, the cage vent holes 69 should not be in alignment with the vents 32 in the top 30 or the top cover 13. This misalignment will further frustrate a refiner from drilling through the top cover 13 and the top 30 to reach the vent holes in the drill resistant cage 60.

The drill resistant cage 60 can also be inserted into the central reservoir 15 and forced against the walls. In those prior art cartridge 10 configurations where foam material is present, the foam would force the walls of the drill resistant cage 60 against the walls of the central reservoir 15. In an alternate embodiment, the walls of the drill resistant cage 60 can be constructed integral to the walls of the cartridge 10.

It is possible that some refiners would use a drill bit of sufficient hardness to penetrate the drill resistant cage 60. To prevent refill in such cases, there is a bit-grabbing mesh 70 disposed inside and against the drill resistant cage 60. The bit-grabbing mesh 70 is constructed of a moderately fine, non-corroding, wire mesh material, similar to steel wool. It is also possible to use other non-corrosive fibrous materials. This mesh material is designed to snare—or engage and catch—the bit of a drill that could penetrate the steel cage 60, thus frustrating that method of accessing the central reservoir 15. In the preferred embodiment, the bit-grabbing mesh 70 would be approximately one eighth of an inch thick (⅛") and disposed against the cage top 62, cage bottom 64, cage front wall 61, cage back wall 63, cage left wall 65 and cage right wall 67. In alternate embodiments, the bit-grabbing mesh 70 would be disposed against only the cage top 62 and cage back wall 63, since these are the most common places where refill holes 100 would be drilled. The bit-grabbing mesh 70 can be attached directly to the walls of the central reservoir 15, attached directly to the walls of the drill resistant cage 60, or can be forced against those walls by the foam material inside the central reservoir 15. Another benefit of the bit-grabbing mesh 70 is that when it grabs the drill bit it will initially move violently, and ruin the foam, and puncture the ink altering packets 90 described below.

It should be appreciated that there are hole generating methods (such as lasers) that can penetrate the material of the drill resistant cage 60 and that also would not become caught by the bit-grabbing mesh 70, but this method is designed to thwart the casual refiller, and drive up the cost for the institutional refiller, thus making it cost prohibitive to refill.

As can be appreciated, the drill resistant cage 60 and bit-grabbing mesh 70 would not prevent refill by means of immersing the print head 50 in ink and refilling through a pressure differential between the ink and the central reservoir 15. The most common way to refill by this method is to subject the central reservoir 15 to negative pressure. The means to prevent refining by negative pressure includes at least two pressure valves, defined herein as check valves 80. In the preferred embodiment, the check valves 80 are in the drill resistant cage 60. As seen in FIG. 3, there is a check valve 80 located in the cage top 62, and a second check valve 80 located in the cage bottom 64. In an alternate embodiment, the check valves 80 would be attached near the top 30 of the central reservoir 15 to form a seal, and attached near the bottom 40 of the central reservoir 15 to form a seal. These two check valves 80 create a pressure sensitive, or anti-pressure, chamber. This chamber does not need to be air tight, but merely be sufficiently tight so that the check valves 80 would close under pressure. Under normal atmospheric pressure, the check valves 80 would remain open, allowing the ink 17 to flow through the check valve 80 in the cage bottom 64 and through the channel 51 into the print head 50.

Figure 6:
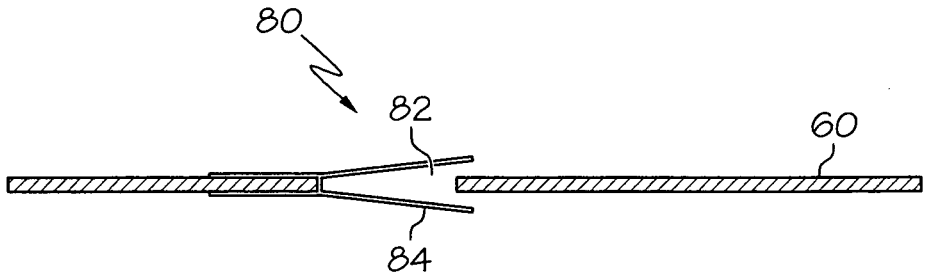
FIG. 6 is a detailed view of the pressure valve.

The check valve 80, as shown in more detail in FIG. 6, consists of an opening 82 in the drill resistant cage 60, and two small flaps 84. The flap 84 can be made of a variety of relatively flexible materials, such as mylar or thin metal. Under normal operation the material of the flap 84 will remain in the opened position. The flap 84 would be deflected into the closed position if there is a change in pressure within the central reservoir 15, or between the central reservoir 15 and the outside environment. Operation of such check valves 80 are well known in the art. If a refiner tries to draw ink 17 into the central reservoir 15 by attempting to produce a vacuum within the central reservoir 15 by means of a vacuum pump attached to the vent hole 32, the flap 84 of the check valve 80 in the cage top 62 would close, thus preventing the creation of negative pressure within the central reservoir 15. Similarly, if the cartridge 10 were inverted and the top 30 or top cover 13 were placed into ink, and a refiner attempted to create a vacuum in the central reservoir 15 by pumping air out through the print head 50, the check valve 80 in the cage bottom 64 would close. The check valves 80 would also close if ink 17 is forced in through either the print head 50 or the vent holes 32. It is important that the check valves 80 be positioned so that they are not interfered with by the various components of the invention such as the bit-grabbing mesh 70 and the ink altering packets 90 as well as the foam that may be present in the central reservoir 15 of the cartridge 10.

Figure 7:
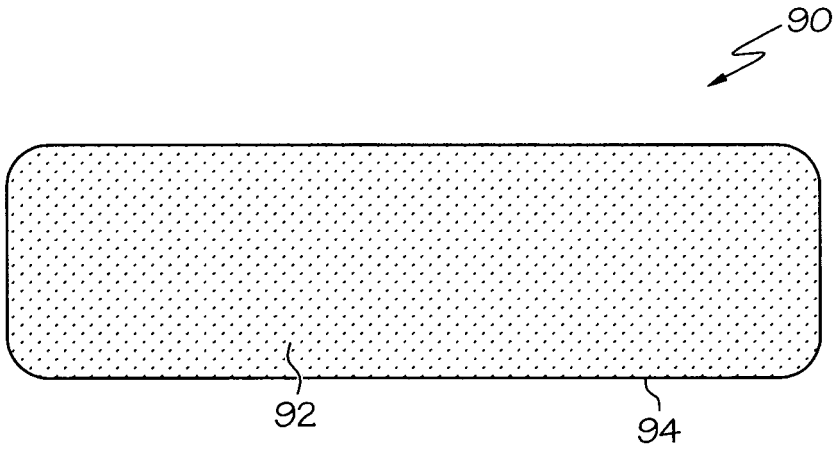
FIG. 7 is a detailed view of the ink altering packet.

Another level of security to prevent refilling is the presence of a number of ink altering packets 90 disposed within the central reservoir 15. As shown in detail in FIG. 7, the ink altering packet 90 is made up of a covering 94 and ink altering material 92 contained inside the ink altering packet 90. The covering 94 can be made of any material that would not degrade in contact with ink 17 or the ink altering material 92. Examples of possible covering material includes polypropylene, HN polyimide film, polyester film, extruded polycarbonate, polyethylene terephthalate, polyester film, low density polyethylene (LDPE) filmgrade, linear low density polyethylene (LLDPE) Hexene Film, ethylene vinyl acetate copolymer (EVA) film, ethylene-methyl acrylate copolymer film, polyolefin film, thermoplastics olefinic elastomer (TPO) film, styrene-butadiene copolymer film, medium density polyethylene (MPDE) film grade film, and polyvinyl dicholoride (PUDC) coated polyester film.

As described above, ink 17 is a liquid that must flow through the nozzle 55 and then adhere to the paper or other material to be printed. Any additive that would degrade the flow of the ink 17, clog the nozzle 55, or prevent the ink 17 from adhering, could be used as an ink altering material 92. As described above, ink 17 must maintain a desired viscosity and surface tension to operate properly. If viscosity is increased sufficiently, the ink 17 will have a tendency to gum up and clog the nozzles 55. In the most preferred embodiment, simple wall-paper paste, in a ratio of 6-8 parts of ink to 1 part of wall paper paste powder, is used as the ink altering material 92. Wall-paper paste is generally made up of "wheat-paste" which is typically dried and powderized wheat gluten. This material becomes sticky when wet. The wall-paper paste would alter the viscosity of the ink 17, essentially making it gluey and sticky and preventing the flow of the ink 17 into the channel 51 and into the print head 50, and thereby clogging the nozzles 55. Virtually any other type of dried and powderized glues could be used since they would exhibit similar ink altering properties as wall-paper paste, and make the ink 17 sticky. It is also possible to use fine sand, metal shavings, or other grit like material as the ink altering material 92. These materials would not change the essential properties of the ink 17, but would clog the nozzle 55 of the print head 50, thus rendering the cartridge 10 inoperable. While it is preferable to use a dry material as the ink altering material 92, it is also possible to use a liquid material that would alter the viscosity and/or surface tension of the ink 17, rendering it unacceptable for printing. Potential examples include alcohol, hydrogen peroxide, mineral oil, and even light liquid glues that would alter the physical or chemical properties of the ink 17.

The ink altering packets 90 may be disposed on the inside of the cage top 62, cage bottom 64, cage front 61, cage back 63, cage right wall 67 and cage left wall 65. In an alternate embodiment, the ink altering packets 90 would be disposed on the inside of either the top 30 of the cartridge or the cage top 62 of the drill resistant cage 60, since this is the most common place where a refiner will drill a refill hole 100. The ink altering packets 90 can be attached to cage 60 by means of an adhesive, or they can be retained against the cage 60 by means of the sponge like foam that is common in most cartridges 10. The foam will lightly force the ink altering packets 90 against the cage 60, holding it into place. The ink altering packets 90 would be placed so as to avoid the vents 32, and if present the one-way check valve 80. In this configuration the ink altering packets 90 would be opened if a drill were to penetrate the drill resistant cage 60, and/or the bit-grabbing mesh 70. In this configuration, if a refiner uses a diamond tipped or carbide drill bit or carborundum abrading instrument, laser or EDM device to penetrate the steel cage 60 and the bit-grabbing mesh 70, the drilling device would then penetrate the ink altering packets 90, release the ink altering material 92 and prevent the reuse of the cartridge 10. It is conceivable, and within the scope of this invention, that the ink altering packets 90 could be used without the drill resistant cage 60 to prevent the use of a refilled cartridge 10. In this embodiment the ink altering packets 90 would be connected directly to the top 30 and/or all the sides of the central reservoir 15, and would be opened when a refiner attempted to drill into the cartridge 10.

In another embodiment, the ink altering packets 90 would be designed to burst in the event that a refiner attempted to refill the cartridge 10 by means of pressure. This would be achieved by the creation of internal pressure inside the ink altering packets 90 by the introduction of air or other inert gas into the ink altering packets 90 along with the ink altering material 92. When the pressure inside the central reservoir 15 is increased or decreased due to the refilling process, the pressure differential between the inside and outside of the ink altering packets 90 would be altered. At a designed pressure differential, the ink altering packet 90 would burst open and release the ink altering material 92. The covering 94 would have to be impervious to both the ink 17 and the ink altering material 92. As mentioned above, there are numerous polymeric materials that are available in thin film form, and these materials can easily be bonded with adhesives or heat sealed into an airtight packet form. The absolute pressure in the cartridge 10 at which the ink altering packets 90 would burst would have to be outside the range of pressure under which that cartridge 10 would normally be expected to operate satisfactorily.

Tests were conducted on commercially available shipping "bubble" packets constructed of thin polymeric film. These were subjected to a vacuum and burst at an absolute external pressure of between 2.5 to 5.0 psia. Calculations have shown that an ink altering packet 90 filled with ink altering material 92 and pressurized air, and constructed of a film material having a thickness of 0.001 in., and a tensile strength of about 5000 psi would burst when subjected to an external absolute pressure of 4.7 psia. Polymeric film materials, as listed above, are available in tensile strengths from below 2000 psi to over 20,000 psi, and in a thickness from around 0.0005 to over 0.080. The preferred embodiment of the ink altering packet 90, therefore, consists of a polymeric film with a thickness of about 0.001 and a tensile strength of about 5000 psi.

As can be appreciated, given the small internal dimensions of the typical cartridge 10, the ink altering packets 90 are also small, having length and width dimensions on the order of an inch, and a thickness of about one eighth of an inch thick. While the dimensions of the ink altering packets 90 can vary they must remain small so that they do not displace volume in the central reservoir 15 needed to contain ink 17, but not so small that they do not contain sufficient ink altering material 92 to alter the properties of the ink 17.

The drawings and above description are illustrative of a typical ink jet printer cartridge. Drawings showing the incorporation of a hardened steel drill resistant cage, a drill resistant mesh and toner altering material packets for a laser or xerographic printer are not shown. It can be easily conceived by those skilled in the art that those components could be incorporated into the toner supply portion of a laser printer cartridge. Four independent methods to impede refilling of inkjet cartridges are disclosed: (1) drill resistant cage; (2) bit-catching mesh; (3) ink property altering packets; and (4) anti-vacuum or high pressure valves. Because the printing material for laser printers is a dry powdered "toner", in general, only the first three methods are appropriate for a laser printer cartridge. Some xerographic printers use a magnetic toner, and in those printers the hardened steel cage would be made from a non-magnetic material such as austenitic 300 series stainless steel.

It is obvious that the original cartridge manufacturer could not easily refill either an ink jet or laser printer cartridge if the refill inhibiting components described herein are incorporated into the cartridge. The original manufacturer could, however, reutilize the expensive components in those cartridges for use in constructing remanufactured products. The print head from an ink jet cartridge and the electro-photographic process rolls from a laser printer cartridge are examples of the components that could be salvaged with proper initial cartridge design.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A method for preventing the refill of a cartridge having a central reservoir defined therein, said method comprising the steps of:

providing a drill resistant cage disposed within the central reservoir of the cartridge, wherein said drill resistant cage prevents a refiller from drilling into the central reservoir with a drill having a bit and introducing a refill ink;

providing a drill bit grabbing mesh disposed within said drill resistant cage, wherein said bit grabbing mesh would impede attempts to drill into the central reservoir;

providing a series of pressure valves within the central reservoir, wherein said pressure valves would close to prevent the introduction of refill ink into the central reservoir by means of a pressure differential;

providing an ink altering material contained within one or more ink altering packets disposed in the central reservoir, wherein said ink altering packets would open during attempted refill and release said ink altering material thus fouling the ink and preventing use of the cartridge.

2. The method for preventing the refill of a cartridge of claim 1 wherein said central reservoir has a top, a bottom, a front wall, a back wall, a right side wall and a left side wall, and wherein said method includes the step of providing said drill resistant cage with a cage top disposed against said central reservoir top to prevent the refiller from drilling through the central reservoir top to access said central reservoir.

3. The method for preventing the refill of a cartridge of claim 2 including the further step of placing said bit grabbing mesh against said cage top.

4. The method for preventing the refill of a cartridge of claim 1 wherein said central reservoir has a top, a bottom, a front wall, a back wall, a right side wall and a left side wall, and wherein said method includes the step of providing said drill resistant cage with a cage top disposed against said reservoir top, a cage bottom disposed against said reservoir bottom, a cage front wall disposed against said reservoir front wall, a cage back wall disposed against said reservoir back wall, a cage right side wall disposed against said reservoir right side wall, and a cage left side wall disposed against said reservoir left side wall, wherein said drill resistant cage prevents a refiller from drilling into and accessing said central reservoir from any point on the cartridge.

5. The method for preventing the refill of a cartridge of claim 4 including the further step of placing said bit grabbing mesh against said cage top, said cage bottom, said cage front wall, said cage back wall, said cage right side wall and said cage left side wall.

6. The method for preventing the refill of a cartridge of claim 4 comprising the further step of incorporating a top pressure valve within said cage top and a bottom pressure valve within said cage bottom, wherein said pressure valves would close if the refiller attempts to introduce ink into said central reservoir by means of a pressure differential.

7. The method for preventing the refill of a cartridge of claim 4 wherein comprising the further step of attaching said ink altering packets to said cage top, cage bottom, cage front wall, cage side wall, cage right side wall and cage left side wall.

8. The method for preventing the refill of a cartridge of claim 7 comprising the further step of providing said ink altering packets with a pressure sensitive covering material that would burst when the pressure within the central reservoir is altered, releasing said ink altering material into the central reservoir.

9. The method for preventing the refill of a cartridge of claim 1 wherein said drill resistant cage is made from heat treatable 400 series stainless steel that is stamped, formed and heat treated to about rc 50-55.

10. The method for preventing the refill of a cartridge of claim 1 wherein said central reservoir has a top, a bottom, a front wall, a back wall, a right side wall and a left side wall and wherein said method includes the further step of providing a bit grabbing mesh is disposed against said reservoir top.

11. The method for preventing the refill of a cartridge of claim 1 wherein said bit grabbing mesh is made from a fibrous metal material, whereby said bit grabbing mesh would grab a bit that would penetrate said drill resistant cage thereby impeding the removal of said bit.

12. The method for preventing the refill of a cartridge of claim 1 wherein said central reservoir has a top, a bottom, a front wall, a back wall, a right side wall and a left side wall, and wherein said method comprises the further step of inserting a top pressure valve disposed against said reservoir top and a bottom pressure valve disposed against said reservoir bottom; whereby said pressure valves would close if the refiller attempts to introduce a refill ink into said central reservoir by means of a pressure differential to either force said refill ink into said central reservoir or create a vacuum to draw said refill ink into said central reservoir.

13. The method for preventing the refill of a cartridge of claim 1 wherein said central reservoir has a top, a bottom, a front wall, a back wall, a right side wall and a left side wall, and wherein said method comprises the further step of attaching a multiplicity of ink altering packets to reservoir top; whereby said ink altering packets would be opened if an object pierces said drill resistant cage top and said ink altering packets, whereby said ink altering material would alter the properties of a refill ink introduced into said reservoir rendering said ink unusable.

14. A device for the prevention of refilling a cartridge having a central reservoir defined therein, said device comprising a hardened drill resistant cage disposed within the central reservoir of said cartridge, wherein said drill resistant cage prevents drilling into said central reservoir and the introduction of a refill material.

15. The device for the prevention of refilling a cartridge of claim 14, wherein said refill material is either ink or toner.

16. The device for the prevention of refilling a cartridge of claim 14, wherein said hardened drill resistant cage is made from heat treatable 400 series stainless steel that is stamped, formed and heat treated to about rc 50-55.

17. The device for the prevention of refilling a cartridge of claim 14 having a central reservoir defined therein, said central reservoir further defined by a top, a bottom, a front wall, a back wall, a right side wall and a left side wall, and said drill resistant cage further defined by a cage top disposed against said reservoir top, a cage bottom disposed against said reservoir bottom, a cage front wall disposed against said reservoir front wall, a cage back wall disposed against said reservoir back wall, a cage right side wall disposed against said reservoir right side wall, and a cage left side wall disposed against said reservoir left side wall, wherein said drill resistant cage prevents a refiller from drilling into and accessing said central reservoir with a drill having a bit and introducing a refill material.

18. A device for the prevention of refilling a cartridge having a central reservoir defined therein, said device comprising a bit grabbing mesh disposed within said central reservoir, wherein said bit grabbing mesh would grab a drill bit of an attempted refiller, thus impeding the refillers ability to drill into said central reservoir.

19. The device for the prevention of refilling a cartridge of claim 18, wherein said bit grabbing mesh is made of a thin fibrous metal mesh material.

20. The device for the prevention of refilling a cartridge of claim 18, wherein said bit grabbing mesh is approximately one eighth inch (⅛") thick and is disposed against the walls of said central reservoir.

21. The device for the prevention of refilling of a cartridge of claim 18 wherein said central reservoir is defined by a top, a bottom, a front wall, a back wall, a right wall and a left wall, and wherein said bit grabbing mesh is disposed against said top.

22. The device for the prevention of refilling of a cartridge of claim 18 wherein said central reservoir is defined by a top, a bottom, a front wall, a back wall, a right wall and a left wall, and wherein said bit grabbing mesh is disposed against said top, said bottom, said front wall, said back wall, said right wall and said left wall.

23. A device for the prevention of refilling a cartridge having a central reservoir defined therein, said central reservoir further defined by a top, a bottom, a front wall, a back wall, a right wall and a left wall, wherein said device comprising an anti-pressure chamber created by a bottom plate having a bottom two way check valve therein, said bottom plate disposed near said central reservoir bottom such that a tight seal is created in said central reservoir when said bottom check valve is closed, and wherein said anti-pressure chamber is further created by a top plate having a top two way check valve therein, said top plate disposed near said central reservoir top such that a tight seal is created in said central reservoir when said top two way check valve is closed; whereby said top check valve and said bottom check valve would close in the event that a refiller attempts to introduce a refill material into said central reservoir by means of a pressure differential.

24. The device for the prevention of refilling a cartridge of claim 23, wherein a drill resistant cage is disposed therein, said drill resistant cage having a cage top disposed against said reservoir top, a cage bottom disposed against said reservoir bottom, a cage front wall disposed against said reservoir front wall, a cage back wall disposed against said reservoir back wall, a cage right wall disposed against said reservoir right wall, and a cage left wall disposed against said reservoir left wall, and wherein a top check valve is incorporated into said cage top, and a bottom check valve is incorporated into said cage bottom.

25. A device for the prevention of refilling a cartridge having a central reservoir defined therein, said device comprising an ink altering material contained within a multiplicity of ink altering packets, wherein said ink altering packets are opened during attempted refill thus releasing said ink altering material into a refill ink thereby preventing use of the refill ink.

26. The device for the prevention of refilling a cartridge of claim 25, wherein said ink altering material is dried wall paper paste powder.

27. The device for the prevention of refilling a cartridge of claim 25, wherein said central reservoir is further defined by a top, a bottom, a front wall, a back wall, a right side wall and a left side wall, and wherein said ink altering packets are disposed against said top, and are opened by a refiller using a drill with a bit to penetrate said top to introduce a refill ink; whereby said bit penetrates said ink altering packet and releases said ink altering material and said ink altering material mixes with said refill ink thus altering the properties of said ink to render said ink unusable.

28. The device for the prevention of refilling a cartridge of claim 25, wherein said central reservoir is further defined by a top, a bottom, a front wall, a back wall, a right side wall and a left side wall, and wherein said ink altering packets are disposed against said top, said bottom, said front wall, said back wall, said right wall, and said left wall, and are opened by a refiller using a drill with a bit to penetrate one of the walls of said reservoir, whereby said ink altering material is released thus preventing the use of said cartridge.

29. The device for the prevention of refilling a cartridge of claim 25, wherein said central reservoir is further defined by a top, a bottom, a front wall, a back wall, a right side wall and a left side wall, and wherein said ink altering packets are disposed against said top, said bottom, said front wall, said back wall, said right wall, and said left wall, wherein said ink altering packets contain a thin covering material and said ink altering material contained therein under pressure, wherein said thin covering material bursts if a refiller attempts to introduce ink into the central reservoir by means of a pressure differential.

* * * * *